US006307077B1

(12) United States Patent
Quear

(10) Patent No.: US 6,307,077 B1
(45) Date of Patent: Oct. 23, 2001

(54) METHOD FOR PURIFYING VEGETABLE OIL OBTAINED BY MECHANICAL EXTRACTION

(76) Inventor: Robert Michael Quear, 16112 E. 196th St., Noblesville, IN (US) 46060

( * ) Notice: Subject to any disclaimer, the term of this patent is extended or adjusted under 35 U.S.C. 154(b) by 0 days.

(21) Appl. No.: 09/370,496

(22) Filed: Aug. 9, 1999

(51) Int. Cl.[7] ..... C11B 3/00
(52) U.S. Cl. ..... 554/175; 554/211
(58) Field of Search ..... 554/175, 211

(56) References Cited

U.S. PATENT DOCUMENTS

| | | | |
|---|---|---|---|
| 2,029,261 | 1/1936 | Ginn | 260/19.2 |
| 2,216,658 | 10/1940 | Anderson | 260/412 |
| 4,035,402 | 7/1977 | Levine | 260/425 |
| 4,265,826 | 5/1981 | Iida et al. | 260/428 |
| 4,507,244 | 3/1985 | von Rappard et al. | 260/428.5 |
| 4,545,940 | 10/1985 | Mutoh et al. | 260/428 |
| 4,609,500 | 9/1986 | Strecker | 260/423 |
| 4,675,133 | 6/1987 | Eggers et al. | 260/412.2 |
| 4,794,011 | 12/1988 | Schumacher | 426/448 |
| 5,482,633 | 1/1996 | Muraldihara et al. | 210/651 |
| 5,626,756 | 5/1997 | Heidlas et al. | 210/634 |
| 5,647,899 | 7/1997 | Lightcap, Jr. | 106/244 |
| 5,696,278 | 12/1997 | Segers | 554/176 |

*Primary Examiner*—Deborah D. Carr
(74) *Attorney, Agent, or Firm*—Woodard, Emhardt, Naughton, Moriarty & McNett

(57) ABSTRACT

This invention relates to a method of refining a crude vegetable oil by removing insoluble material from the oil to provide a substantially clarified oil. The process comprises cooling the vegetable oil and maintaining the vegetable oil at the desired low temperature. The vegetable oil is then heated to provide an amount of a substantially clarified oil that can be separated from the insoluble material. The process is useful for a wide variety of oils including soybean oil, sunflower oil, safflower oil, corn oil, sesame oil, rapeseed oil, linseed oil, cottonseed oil, rice bran oil, perilla oil, castor oil, olive oil, tsubaki oil, coconut oil, palm oil, hemp seed oil, tung oil, kapok oil, tea seed oil.

20 Claims, No Drawings

METHOD FOR PURIFYING VEGETABLE OIL OBTAINED BY MECHANICAL EXTRACTION

FIELD OF THE INVENTION

This invention generally relates to a method of purifying oils. More specifically this invention is directed to a method of purifying a vegetable oil to provide a clarified vegetable oil.

BACKGROUND OF THE INVENTION

Vegetable oils find a wide variety of uses in consumer products including use as food additives, lubricants, solvents and coating additives. Most applications require refined vegetable oil that is essentially colorless to light yellow and free from insoluble material. Generally, vegetable oil is obtained by dry extruding vegetables, for example, vegetable seeds, in a friction extruder-usually at a temperature of greater than 130° C. to provide a semi-fluid extrudate. Then the semi-fluid extrudate is processed in a screw press to yield a crude vegetable oil and a solid or semi-solid vegetable meal, which is separated from the crude vegetable oil. Despite this initial separation, the crude vegetable oil still contains a variety of suspended insoluble solids. The suspended insoluble solids include semi-solid or gummy material that can be particularly difficult to remove by typical mechanical separation means. The insoluble solids do not readily precipitate from the crude oil. Attempts to filter out the insoluble solids present problems because the semi-solid and/or gummy material clogs the filter medium.

In an effort to address these problem, in the past crude oil has been refined using a solvent extraction process. In a solvent extraction process the crude oil is extracted with an organic solvent, for example, a mixture of hexanes. The organic solvent absorbs greater than 90% of the seed oils. The extract can be filtered, if necessary, to remove any particulate and/or insoluble matter. After filtering, the solvent is removed, typically by evaporation, to provide a partially refined vegetable oil, which can be used in many commercial products or further processed if desired.

While solvent extraction provides a process for refining vegetable oil, this process presents some significant problems. Along with the insoluble material, many of the beneficial, natural nutrients such as antioxidants and vitamins are removed from the vegetable oil. Both the extracted oil and solid material inevitably contain residual hexanes. Hexanes are toxic to humans and other animals and must be removed before the resulting oil and solid material are suitable for consumption by humans and other animals. While the hexanes are recycled for reuse, inevitably a significant amount of hexanes escape into the atmosphere and contribute to environmental pollution. In addition, hexane is an extremely flammable solvent and, therefore, presents a significant risk to fire and explosions. It is desirable to provide an alternative process for purifying vegetable oil.

Thus, there is a need to provide a process for purifying vegetable oils that avoids the problems described above. The present invention addresses this need in a novel and non-obvious way.

SUMMARY OF THE INVENTION

Accordingly, there is provided in accordance with the present invention a novel process for purifying a vegetable oil. In one form, the process removes insoluble material from crude vegetable oil. The process comprises the steps of maintaining the crude oil at a temperature below about 10° C.; heating the crude oil to a temperature sufficient to provide an amount of substantially clarified oil; and drawing off the substantially clarified oil. In preferred embodiments the vegetable oil is cooled to a temperature to induce the insoluble material to agglomerate and to form larger masses of insoluble material. More preferably, the crude oil is cooled to a temperature between about 5° C. and about 0° C. The vegetable oil may be maintained at this cold temperature for a selected amount of time, preferably between about 1 hour and about 8 hours. After the vegetable oil has been cooled, typically the oil is rapidly heated to induce the insoluble material to precipitate. In preferred embodiments, the vegetable oil is heated to a temperature between about 50° C. and about 80° C. A wide variety of crude vegetable oils can be processed according to this invention. For example, the vegetable oil can be selected from soybean oil, sunflower oil, safflower oil, corn oil, sesame oil, rapeseed oil, linseed oil, cottonseed oil, rice bran oil, perilla oil, castor oil, olive oil, tsubaki oil, coconut oil, palm oil, perilla oil, hemp seed oil, tung oil, kapok oil, tea seed oil and mixtures thereof This invention provides a clarified vegetable oil, which can be readily separated from the solid particles.

In yet another embodiment of the present invention, there is provided a process for purifying a vegetable oil composition containing insoluble matter. The process comprises cooling the vegetable oil to a temperature below about 10° C.; maintaining for a time to obtain agglomeration; heating to a temperature above about 50° C. to provide a clarified vegetable oil capable of being separated from the insoluble material; and drawing off the substantially clarified vegetable oil.

Further objects, features, aspects, forms, advantages and benefits shall become apparent from the description contained herein.

DETAILED DESCRIPTION OF THE INVENTION

For the purposes of promoting an understanding of the principles of the invention, reference will now be made to the embodiments illustrated herein and specific language will be used to describe the same. It will nevertheless be understood that no limitation of the scope of the invention is thereby intended. Any alterations and further modifications in the described processes, systems or devices, and any further applications of the principles of the invention as described herein, are contemplated as would normally occur to one skilled in the art to which the invention relates.

In general the present invention provides an improved process for purifying vegetable oil. The process provides clarified oil that is substantially free of insoluble material. The resulting clarified oil is useful for a variety of applications and can be included in a food additive, a solvent, a lubricant, a diluent, a coating additive or further purified in a subsequent downstream process. In one form, the process provides the clarified oil without requiring solvent extraction of the crude oil. In another form, the present invention refines the oil by removing insoluble material. This process uses minimal mechanical manipulations, and decreases production time, cost, and harm to the environment, while still providing a refined oil that is substantially free of insoluble material.

The process is useful to purify a wide variety of oils, including oils obtained from vegetables, preferably seed vegetables. Typically, but not required, the crude oil processed using the present invention is received directly from an extractor and/or extruding process. The vegetable oil can be crude oil or it can be partially processed oil in need of further refining. It is to be understood that oil from any source is potentially useful with the present invention.

As has been mentioned, the vegetable oil for use in the present invention can be derived from a wide variety of vegetables, primarily, but not exclusively vegetable seeds. Typical examples of vegetable oils for use with this invention include soybean oil, sunflower oil, safflower oil, corn oil, sesame oil, rapeseed oil, linseed oil, cottonseed oil, rice bran oil, perilla oil, castor oil, olive oil, tsubaki oil, coconut oil, palm oil, hemp seed oil, tung oil, kapok oil, tea seed oil and mixtures of these oils.

The insoluble material in the crude oil may be of any form such is commonly found in vegetable oil and may appear as particulate, flocculent, or waxy material. The insoluble material can cause the crude oil to appear turbid, cloudy or discolored. The crude vegetable oil can include seed debris, lecithins, phospholipids (phosphatides), free fatty acids, sterols, and unsaponified matter as well as a variety of other insoluble material. The insoluble material can originate from a variety of sources including the vegetable, vegetable debris, by-products from prior processing procedures or other sources.

According to this invention the greater than about 75% by volume of the insoluble material is removed from the crude vegetable oil. More preferably greater than about 85% by volume of the insoluble material is removed, and yet still more preferably greater than about 95% by volume of the insoluble material is removed from the crude vegetable oil. Thus, the clarified oil prepared according to this invention comprises less than about 25% by volume insoluble material. More preferably clarified oil comprises less than 15% by volume insoluble material; yet still more preferably, the clarified oil comprises less than about 10% by volume or less of the insoluble material. The resulting clarified oil is substantially a clear liquid having exhibiting an amber color.

In one form of the invention process, the crude vegetable oil received from mechanically extraction is cooled. Preferably the crude vegetable oil is cooled sufficiently to induce agglomeration or to cause the insoluble matter to mass together. In preferred embodiments, the vegetable oil is cooled to a temperature below about 10° C., more preferably, between about 5° and 0° C. It is understood that lower temperatures can be used if necessary or desired. For example, lower temperatures can be employed to induce semi-solid or gummy insoluble material to become hardened and even solidify in some circumstances. Those skilled in the art will appreciate that typically the lower temperatures decrease the solubility of other material, which may be contained in the crude vegetable oil, and thus, cooling the vegetable oil can also induce separation of additional solid or semi-solid material from the crude oil. The additional insoluble material may also be removed using this process.

The vegetable oil can be maintained at the desired low temperature for a time selected to induce the insoluble material to form larger masses of insoluble material and/or enhance separation of the insoluble material from the vegetable oil. In preferred embodiments, the vegetable oil is maintained at the desired low temperature for about 1 hour to about 8 hours; more preferably, about 2 hours to about 4 hours. While it is understood that longer times can be employed to allow the insoluble material to form larger masses, it has been discovered that the majority of the insoluble material separates from the oil within about 8 hours.

During the period the vegetable oil is maintained cold, it is desirable that the cold oil remain undisturbed to avoid stirring up any material that has begun to precipitate from the crude oil. However, it has been observed that the insoluble material does not always precipitate from the cold, crude oil. It will be appreciated that the cooled oil exhibits increased viscosity, and, generally, the lower the temperature, the more viscous the oil becomes. At sufficiently low temperatures the crude oil can obtain a "gel-like" consistency. While not intending to be bound by any theory, it is thought that the insoluble material exhibits an increased tendency to remain suspended in the cold, viscous oil. Thus, while the colder temperatures can induce the insoluble material to agglomerate and/or form larger masses this material often remains suspended in the cold oil.

After the vegetable oil has been maintained at the desired temperature for the selected amount of time, the oil is heated to provide a clarified oil that is capable of being separated from the insoluble material. In preferred embodiments, the vegetable oil is heated to a temperature above 50° C., but not to exceed the temperature at which a substantial portion of the oil thermally degrades. Preferably, the oil is heated to a temperature between about 50° C. and about 80° C.; still more preferably, between about 60° C. and about 70° C. The heating can be accomplished by a variety of methods including any method commonly used or known in the art.

In an alternate form of the present invention it is desirable to rapidly heat the oil to the desired temperature. Preferably the oil is heated at a rate of about 50° C./hour to about 80° C./hour; more preferably, about 60° C./hour to about 70° C./hour. Most preferably, the oil is heated in a manner to maintain the insoluble material in a semi-solid or solid state that does not dissolve in the heated vegetable oil.

It has been discovered that heating the crude oil facilitates separation of the insoluble material from the crude oil to provide a substantially clarified oil. While not to be bound by any theory, it is thought that heating the oil increases the fluidity (or decreases the viscosity) of the crude oil sufficiently to allow the insoluble material to readily separate from the oil. Thus, it is desirable to heat the oil in a manner to decrease the viscosity of the oil while maintaining the insoluble material as an agglomerated mass. In addition, it is thought that the vegetable oil exhibits a greater thermal conductivity than the insoluble material. Thus, the oil absorbs sufficient energy from the applied heat to exhibit a less viscous behavior. The insoluble material remains as an agglomerated material in a hardened or semi-hardened state, which precipitates from the heated vegetable oil.

The clarified oil is separated from the insoluble material using any of the methods commonly used in the art including decanting, pouring, siphoning, and pumping the clarified oil from the settling tank. The most preferable method for withdrawing the clarified oil includes decanting the clarified oil from the settling tank. As with any separation process, complete separation may not always achieved. In practice it may be desirable to remove the bulk of the clarified oil and leave a residual portion of the vegetable oil in the settling tank with the precipitated material. This residual portion of vegetable oil and any entrained solid material can be recycled in a subsequent refining procedure.

In an alternative form, the clarified oil can be separated from the insoluble material by removing the insoluble material from the bottom of the settling tank leaving the clarified oil in the settling tank. This method also provides an effective separation of the insoluble material from the clarified oil. The insoluble material and any residual oil contained therein can be collected for use in other applications, such as in animal feed, or the insoluble material and the residual oil can be collected and further refined in a subsequent refining procedure.

This process provides a substantially clarified oil that is suitable for many commercial applications. Further, this novel process can be used in conjunction with a variety of subsequent processing procedures including filtering, chemical extraction, bleaching, and decolorizing. Thus, this inventive process provides particular advantages by reducing the cost and efforts needed in subsequent refinement processes.

The present invention contemplates modifications as would occur to those skilled in the art. It is also contemplated that processes embodied in the present invention can be altered, rearranged, substituted, deleted, duplicated, combined, or added to other processes as would occur to those skilled in the art without departing from the spirit of the present invention. In addition, the various stages, steps, procedures, techniques, phases, and operations within these processes may be altered, rearranged, substituted, deleted, duplicated, or combined as would occur to those skilled in the art. Further, any theory of operation, proof, or finding stated herein is meant to further enhance understanding of the present invention and is not intended to make the scope of the present invention dependent upon such theory, proof, or finding.

For the purpose of promoting further understanding and appreciation of the present invention and its advantages, the following Examples are provided. It will be understood, however, that these Examples are illustrative and not limiting in any fashion.

Example 1

Approximately 500 gallons (1890 liters) of a crude soybean oil obtained from an extruding-expelling process commonly used in the art was charged to a 500 gallon settling tank that included a chilling unit. (M-500 model, manufactured by Mueller) The crude soybean oil was chilled to about 36°–38° F. (2–3° C.). The crude soybean oil was maintained between 36° and 38° F. for an additional 2 hours. The chilled soybean oil was then rapidly heated to 150° F. (65° C.) by inserting 6 electric heating units (742 G manufactured by Allied Precision) into the chilled soybean oil. As the oil heated up, the insoluble material settled to the bottom of the settling tank. The hot clarified soybean oil was then decanted from the settling tank to provide 495 gallons (1735 liters) of a clarified soybean oil.

The above-described process can be repeated up to 4 or 5 times with different batches of crude oil before the total accumulated insoluble material is collected and removed from the settling tank. The soybean oil thus processed exhibited a clear liquid having an amber color.

While the invention has been illustrated and described in detail in the drawings and foregoing description, the same is considered to be illustrative and not restrictive in character, it is understood that only the preferred embodiments have been shown and described and that all changes and modifications that come within the spirit of the invention are desired to be protected.

What is claimed is:

1. A process for purifying vegetable oil, said process comprising:

maintaining the vegetable oil at a temperature below about 10° C.;

heating the vegetable oil to a temperature sufficient to provide an amount of substantially clarified oil; and drawing off the clarified vegetable oil.

2. The process of claim 1 wherein the vegetable oil is selected from soybean oil, sunflower oil, safflower oil, corn oil, sesame oil, rapeseed oil, linseed oil, cottonseed oil, rice bran oil, perilla oil, castor oil, olive oil, tsubaki oil, coconut oil, palm oil, hemp seed oil, tung oil, kapok oil, tea seed oil and mixtures thereof.

3. The process of claim 1 wherein said maintaining includes maintaining the vegetable oil at a temperature between about 10° C. and about 0° C.

4. The process of claim 1 wherein said maintaining includes maintaining the vegetable oil at a temperature below about 10° C. for a selected amount of time.

5. The process of claim 1 wherein said maintaining includes maintaining the vegetable oil at a temperature below about 10° C. for about 1 hour to about 8 hours.

6. The process of claim 1 wherein said heating includes heating the vegetable oil to a temperature above about 50° C.

7. The process of claim 1 wherein said heating includes heating the vegetable oil at a temperature between about 50° C. and about 80° C.

8. The process of claim 1 wherein said heating includes heating the vegetable oil at a rate of from about 90° C. per hour to about 125° C. per hour.

9. The process of claim 1 wherein said drawing off the clarified oil includes decanting the vegetable oil.

10. The process of claim 1 wherein an insoluble material precipitates from the vegetable oil during said heating.

11. A process for purifying a vegetable oil composition containing insoluble material, said process comprising:

cooling the vegetable oil to a temperature below about 10° C.;

maintaining for a time to obtain agglomeration;

heating to a temperature above about 50° C. to provide a clarified vegetable oil capable of being separated from the insoluble material; and drawing off the substantially clarified vegetable oil.

12. The process of claim 11 wherein the vegetable oil is selected from soybean oil, sunflower oil, safflower oil, corn oil, sesame oil, rapeseed oil, linseed oil, cottonseed oil, rice bran oil, perilla oil, castor oil, olive oil, tsubaki oil, coconut oil, palm oil, hemp seed oil, tung oil, kapok oil, tea seed oil and mixtures thereof.

13. The process of claim 11 wherein said cooling includes cooling the vegetable oil to a temperature between about 10° C. and about 0° C.

14. The process of claim 11 wherein said cooling includes maintaining the vegetable oil at a temperature sufficient to induce agglomeration of the insoluble material for about 1 hour to about 8 hours.

15. The process of claim 11 wherein said heating includes heating the vegetable oil to a temperature above about 50° C.

16. The process of claim 11 wherein said heating includes heating the vegetable oil to a temperature between about 50° C. and about 80° C.

17. The process of claim 11 wherein said heating includes heating the vegetable oil at a rate of about 90° C. per hour to about 125° C. per hour.

18. The process of claim 11 wherein said drawing off the clarified oil includes decanting the vegetable oil.

19. The process of claim 11 wherein the clarified oil comprises less than about 25% by volume insoluble material.

20. The process of claim 11 wherein the clarified oil comprises less than about 15% by volume insoluble material.

* * * * *